United States Patent [19]

Price

[11] Patent Number: 4,628,664

[45] Date of Patent: Dec. 16, 1986

[54] BOTTOM TUCK DEVICE FOR ICE CREAM SANDWICH WRAPPING MACHINE

[75] Inventor: Floyd W. Price, Freehold, N.J.

[73] Assignee: Burry-Lu, Inc., Elizabeth, N.J.

[21] Appl. No.: 799,062

[22] Filed: Nov. 18, 1985

[51] Int. Cl.[4] ..... B65B 11/06; B65B 49/08

[52] U.S. Cl. ..... 53/232; 53/223; 53/228; 53/230

[58] Field of Search ..... 53/209, 223, 224, 228, 53/229, 230, 231, 232

[56] References Cited

U.S. PATENT DOCUMENTS

| | | | |
|---|---|---|---|
| 1,975,913 | 10/1934 | Wheeler . | |
| 3,150,475 | 7/1960 | Schooler . | |
| 3,600,875 | 8/1971 | Buob et al | 53/230 |
| 3,834,119 | 9/1974 | Armitt et al. | 53/230 |
| 3,861,120 | 1/1975 | Gordon | 53/230 |
| 4,098,057 | 7/1978 | Holcomb | 53/230 |

FOREIGN PATENT DOCUMENTS

| | | | |
|---|---|---|---|
| 113847 | 3/1925 | Switzerland | 53/230 |

*Primary Examiner*—John Sipos
*Assistant Examiner*—Donald R. Studebaker
*Attorney, Agent, or Firm*—David A. Jackson

[57] ABSTRACT

An ice cream sandwich wrapping apparatus includes an elevator which raises the ice cream sandwich to a wrapping position at which the wrapper extends over the top of and is draped along the sides of the ice cream sandwich, the elevator including a platform having a supporting surface for supporting the ice cream sandwich; a conveyor positioned adjacent the platform and including a conveying surface substantially coplanar with the supporting surface such that the ice cream sandwich can be pushed from the supporting surface to the conveying surface, the conveying surface including at least one recessed section open at an end thereof adjacent the platform; and a shoe movable in a direction toward and into abutment with the ice cream sandwich when the latter is on the supporting surface of the elevator, the shoe including a rear tucker for wrapping a rear buttom tuck panel of the wrapper about the ice cream sandwich as the shoe travels in the direction toward the ice cream sandwich, and a pusher fixedly connected with the rear tucker for pushing the ice cream sandwich from the supporting surface onto the conveying surface during continued movement in the direction toward and into abutment with the ice cream sandwich, the rear tucker extending into the at least one recessed section during such continued movement, wherein a single movement and a single shoe is used for both wrapping the ice cream sandwich and pushing the ice cream sandwich onto the conveyor.

9 Claims, 6 Drawing Figures

FIG. 2
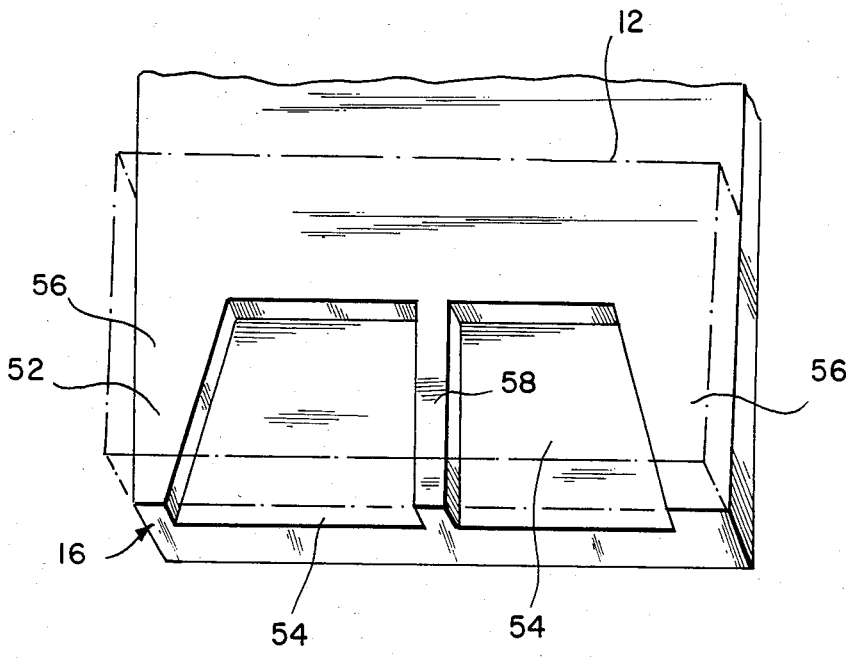
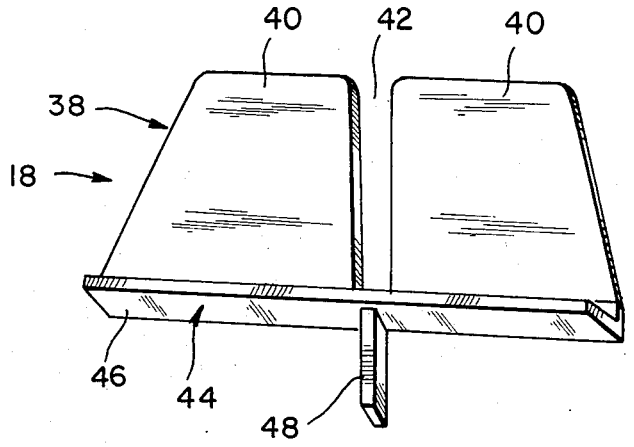
FIG. 3

BOTTOM TUCK DEVICE FOR ICE CREAM SANDWICH WRAPPING MACHINE

This invention relates generally to ice cream sandwich wrapping machines and, more particularly, is directed to a bottom tuck device for an ice cream sandwich wrapping machine.

Ice cream sandwich machines for automatically and continuously producing completed ice cream sandwiches are well known in the art, for example, as disclosed in U.S. Pat. Nos. 2,794,404; 3,119,353; 3,316,860; and 3,834,119.

In such machines, ice cream is extruded through the end of a vertically-oriented nozzle. At the same time, wafers stacked on inclined trays on opposite sides of the nozzle are continuously supplied to form with the extruded ice cream, ice cream sandwiches. The ice cream sandwich consisting of two wafers with extruded ice cream therebetween is formed and carried to an output conveyor by means of an index wheel positioned below the nozzle and having a plurality of pockets therein which receive the wafers and ice cream in the form of a sandwich. The index wheel is then intermittently rotated to position the ice cream sandwiches adjacent a conveyor assembly which carries the finished ice cream sandwiches to an ice cream sandwich wrapping assembly of the machine.

Specifically, the ice cream sandwiches are sequentially supplied, at the end of the conveyor assembly, to an elevator, which raises each ice cream sandwich to the wrapping section of the machine. As the ice cream sandwich is raised by the elevator, it engages a wrapper which covers the top of the ice cream sandwich. As the elevator continues rising, side panel deflectors bend the wrapper about the sides of the ice cream sandwich. At the upper limit of travel of the elevator, separate assemblies are provided for wrapping the bottom tuck panels and end panels of the wrapper about the ice cream sandwich. Thereafter, the ice cream sandwich is pushed onto a take-off conveyor, and the wrapped ice cream sandwiches are transported along the conveyor to a boxing assembly where a plurality of ice cream sandwiches are wrapped together in a single box.

One problem with conventional assemblies is that the assemblies for wrapping the bottom tuck panels and for pushing the ice cream sandwich onto the conveyor are unnecessarily complex and cumbersome.

For example, in U.S. Pat. No. 3,834,119, the entire disclosure of which is incorporated herein by reference, the ice cream sandwich is raised by the elevator to a position within a form whereby the side panels of the wrapper are formed. Thereafter, a rear tucker moves underneath the ice cream sandwich, tucking the rear bottom tuck panel of the wrapper thereunder, the rear tucker then being removed. Then, after the end panels have been tucked, a separate pusher pushes the ice cream sandwich off the platform onto the conveyor, thereby forcing the front bottom tuck panel underneath the ice cream sandwich.

With such arrangement, separate mechanisms must be provided for actuating the rear tucker and the pusher, thereby complicating the construction.

U.S. Pat. No. 4,098,057, the entire disclosure of which is incorporated herein by reference, discloses an ice cream sandwich wrapping machine similar to the aforementioned arrangement. In this patent, a folding shoe supporting plate member wraps the rear bottom tuck panel underneath the ice cream sandwich when the latter is positioned on the elevator. Then, a pusher head pushes the ice cream sandwich onto the conveyor to wrap the front bottom tuck panel underneath the ice cream sandwich.

Specifically, the pusher head and folding shoe supporting plate member move together until the rear bottom tuck panel is tucked underneath the ice cream sandwich. At such time, the folding shoe supporting plate member is prevented from travelling further and is maintained at a position in front of the conveyor. However, the pusher head which is slidably movable with respect to the folding shoe supporting plate member and connected thereto by a tension spring, continues moving toward the conveyor, against the force of the spring, to push the ice cream sandwich from the elevator onto the take-off conveyor. This arrangement, although requiring a single drive, is also relatively complicated since there are separate mechanisms provided for wrapping the rear bottom tuck panel underneath the ice cream sandwich and for then pushing the ice cream sandwich onto the conveyor.

Another problem with such devices is that, after the rear bottom tuck panel has been wrapped underneath the ice cream sandwich, there is a relative movement between the ice cream sandwich and rear tucker (or supporting plate member) opposite to that used to wrap the rear bottom tuck panel. For example, in U.S. Pat. No. 3,834,119, the rear tucker is withdrawn from underneath the ice cream sandwich in a direction opposite to that used to tuck the rear bottom tuck panel. In U.S. Pat. No. 4,098,057 the ice cream sandwich is moved onto the conveyor while the supporting plate member remains stationary. As a result, because of pressure applied by the rear tucker or supporting plate member to the bottom of the ice cream sandwich, there may be a tendency for the rear bottom tuck panel to remain with the rear tucker or supporting plate member whereby it is withdrawn slightly from the tucked position underneath the ice cream sandwich, thereby providing an incomplete or erroneous wrap.

Other wrapping apparatus, although not directed to the ice cream sandwich art, are shown and disclosed in U.S. Pat. Nos. 1,975,913; 3,150,475; and 3,861,120. U.S. Pat. No. 1,975,913 is relevant for its disclosure at FIGS. 8–10 in which a bottom tuck device is pivoted and thereby comes in at an angle to wrap one side of the bottom panel.

OBJECTS AND SUMMARY OF THE INVENTION

Accordingly, it is an object of the present invention to provide an ice cream sandwich wrapping apparatus having a relatively simple, yet novel, arrangement for wrapping the bottom tuck panel underneath the ice cream sandwich and for pushing the ice cream sandwich onto the take-off conveyor.

It is another object of the present invention to provide an ice cream sandwich wrapping apparatus in which a single actuation and movement of a shoe wraps the rear bottom tuck panel underneath the ice cream sandwich and pushes the ice cream sandwich onto the take-off conveyor.

It is still another object of the present invention to provide an ice cream sandwich wrapping apparatus in which the shoe for wrapping and pushing the ice cream sandwich fits within at least one recess in the take-off conveyor, during its travel.

It is yet another object of the present invention to provide an ice cream sandwich wrapping apparatus in which the shoe for wrapping and pushing travels in a relatively straight line at an angle to the ice cream sandwich so as to prevent the rear bottom tuck panel from disengaging from the bottom of the ice cream sandwich during removal of the shoe.

In accordance with an aspect of the present invention, apparatus for wrapping an ice cream sandwich with a wrapper, includes elevator means for raising the ice cream sandwich upwardly from a supply position at which the ice cream sandwich is supplied to the elevator means to a wrapping position at which the wrapper extends over the top of and is draped along the sides of the ice cream sandwich, the elevator means including a platform having a supporting surface for supporting the ice cream sandwich; a take-off conveyor positioned adjacent the platform when the elevator means is moved to the wrapping position, the conveyor including a conveying surface substantially co-planar with the supporting surface when the elevator means is moved to the wrapping position, wherein the ice cream sandwich can be pushed from the supporting surface to the conveying surface, the conveying surface including at least one recessed section open at an end thereof adjacent the platform; and shoe means movable in a direction toward and into abutment with the ice cream sandwich when the latter is supported on the supporting surface, the shoe means including rear tucker means for wrapping a rear bottom tuck panel underneath the ice cream sandwich as the shoe mean travels in the direction toward the ice cream sandwich, and pusher means fixedly connected with the rear tucker means for pushing the ice cream sandwich from the supporting surface onto the conveying surface during continued movement in the direction toward and into abutment with the ice cream sandwich, the rear tucker means extending into the at least one recessed section during such continued movement.

The above and other, objects, features and advantages of the present invention will become readily apparent from the following detailed description thereof which is to read in connection with the accompanying drawings.

BRIEF DESCRIPTION OF THE DRAWINGS

FIG. 2 is a perspective view of a portion of the take-off conveyor of FIG. 1;

FIG. 3 is a perspective view of the shoe of FIG. 1;

DETAILED DESCRIPTION OF A PREFERRED EMBODIMENT

Figure 1:
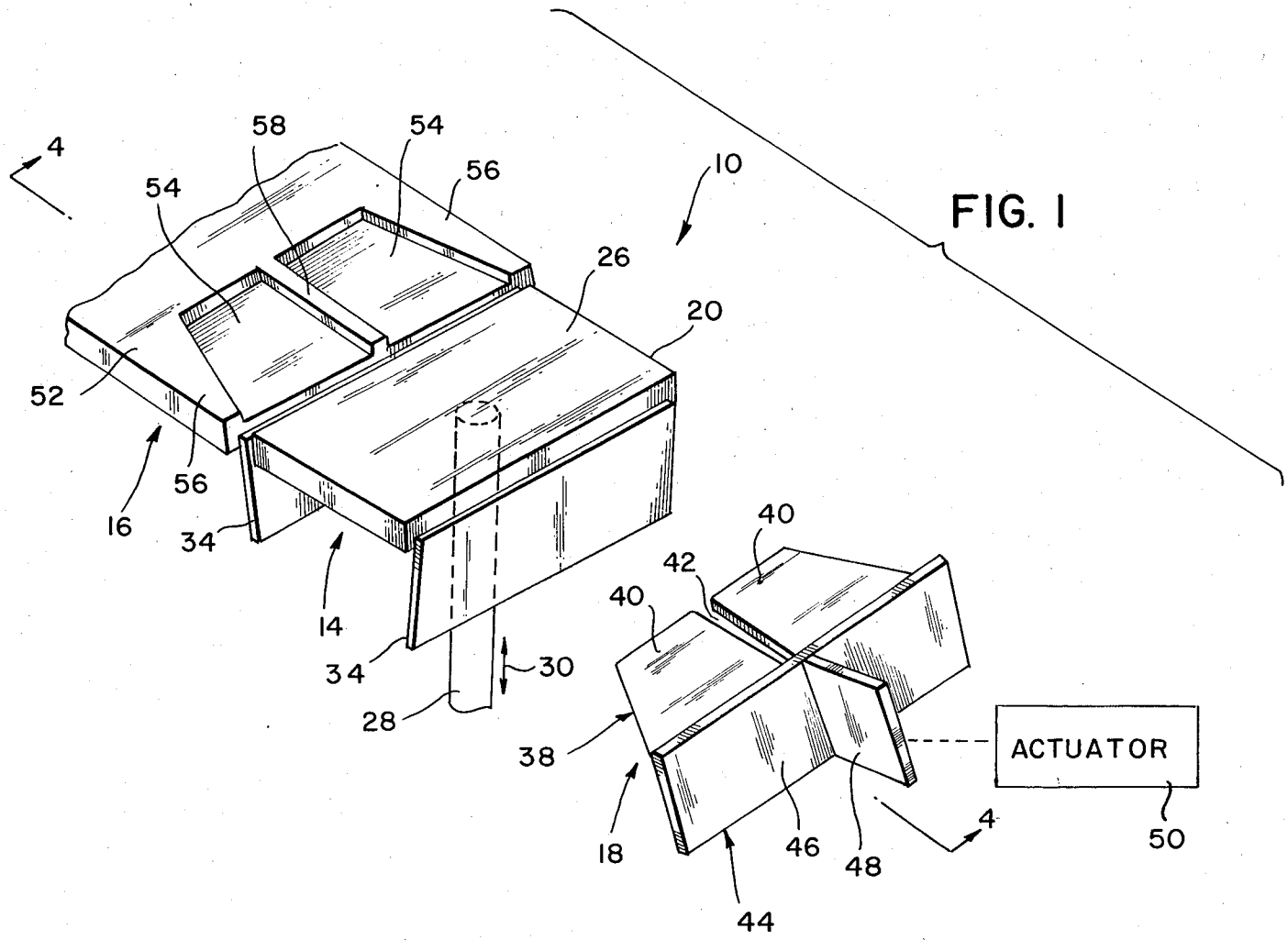
FIG. 1 is a perspective view of a portion of the ice cream sandwich wrapping apparatus according to the present invention.

Referring to the drawings in detail, and initially to FIGS. 1–3 thereof, a portion of apparatus 10 for wrapping an ice cream sandwich 12 generally includes an elevator 14 for raising ice cream sandwich 12 upwardly from a supply position at which the ice cream sandwich is supplied to elevator 14, to a wrapping position, shown in FIG. 1, at which the wrapper extends over the top of and is draped along the sides of ice cream sandwich 12; a take-off conveyor 16 positioned adjacent elevator 14 when the latter is in the wrapping position, wherein ice cream sandwich 12 can be pushed from elevator 14 onto conveyor 16; and a shoe 18 movable in a direction toward and into abutment with ice cream sandwich 12 when the latter is supported on elevator 14 for wrapping a rear bottom tuck panel of the wrapper underneath the ice cream sandwich and for pushing the ice cream sandwich from elevator 14 onto conveyor 16.

As shown in FIG. 1, elevator 14 includes a platform 20 having a flat upper supporting surface 26 for supporting an ice cream sandwich thereon. Elevator 14 further includes a support shaft 28 secured to the bottom of platform 20 by any conventional means and which is movable in the directions of arrow 30, as shown in FIG. 1, between the aforementioned supply position at which an ice cream sandwich 12 is positioned on supporting surface 26, and the wrapping position shown in FIG. 1 in which the wrapper extends over the top of and is draped along the sides of ice cream sandwich 12 (see FIG. 4).

Figure 4:
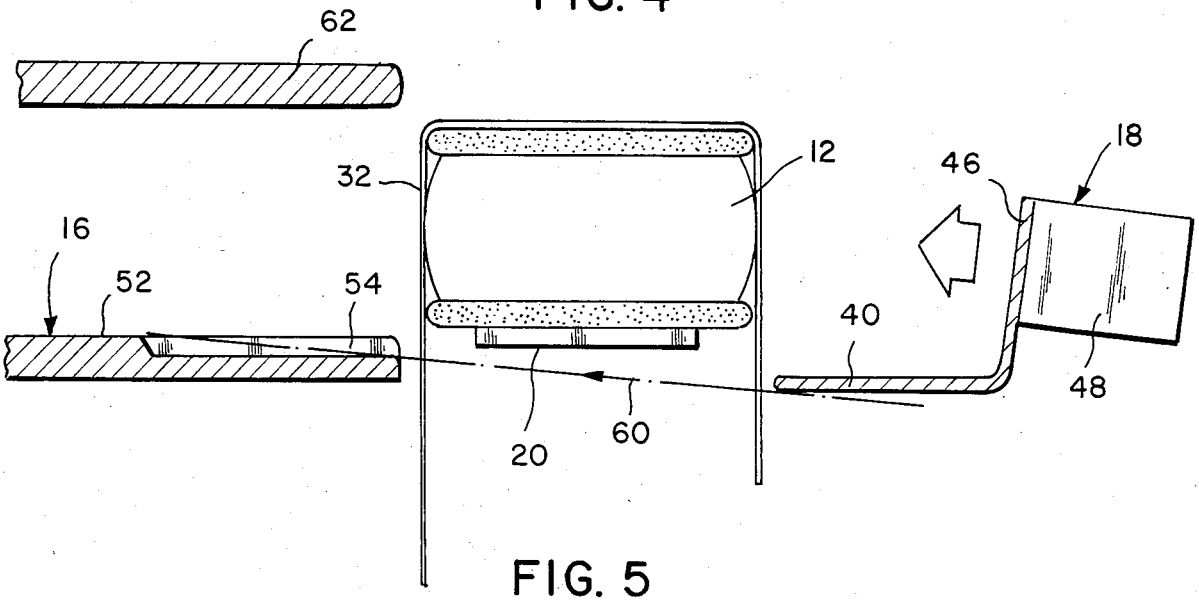
FIG. 4 is a cross-sectional view of a portion of the apparatus of FIG. 1 in a first action view.

Generally, in accordance with the disclosure in the aforementioned U.S. Pat. No. 4,098,057, as elevator 14 moves upwardly to the wrapping position, it hits against and biases an ice cream sandwich wrapper 32 upwardly. In this regard, platform 20 passes between two vertical guides 34 which bend the wrapper 32 such that wrapper 32 is draped along the sides of and extends to a lower position than the bottom of ice cream sandwich 12, as shown in FIG. 4. In this manner, when ice cream sandwich 12 is raised by elevator 14 to the wrapping position shown in FIGS. 1 and 4, the side panels of wrapper 32 are wrapped about the sides of ice cream sandwich 12.

Figure 5:
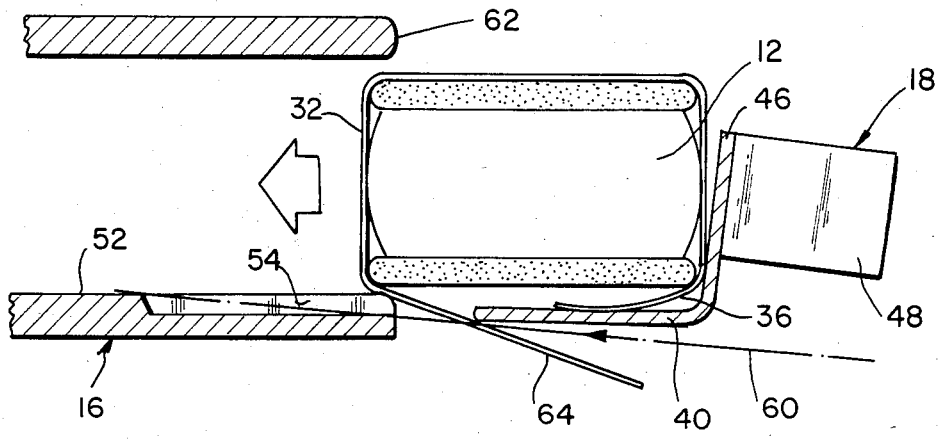
FIG. 5 is a cross-sectional view, showing a second action view of the apparatus of FIG. 4 in which the rear bottom tuck panel is wrapped underneath the ice cream sandwich by the shoe.
Figure 6:
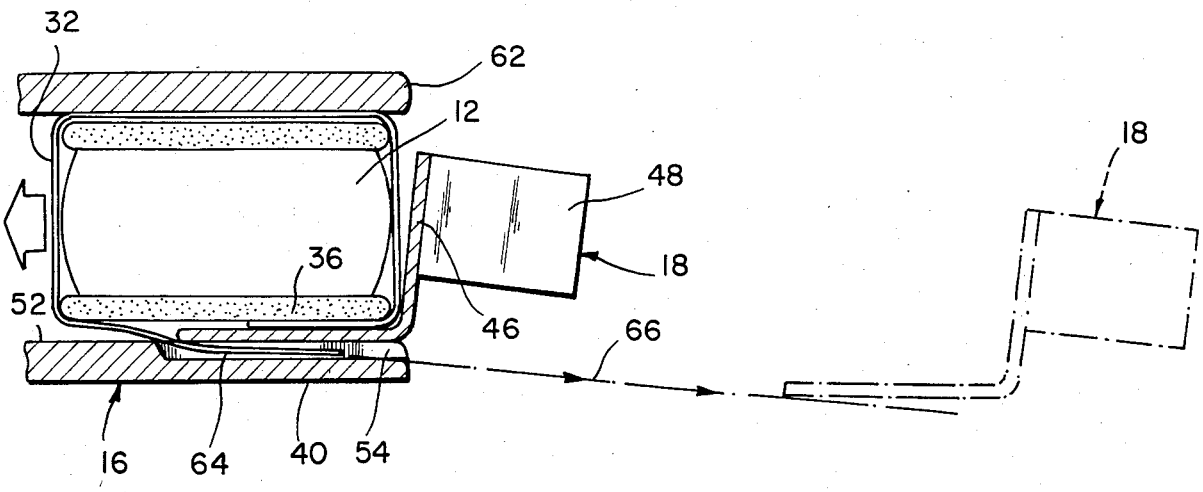
FIG. 6 is a cross-sectional view, showing a final action view in which the shoe pushes the ice cream sandwich onto the take-off conveyor.

In such position, shoe 18 is moved in the leftward direction of FIGS. 1 and 4–6 to wrap the rear bottom tuck panel 36 (FIG. 5) of wrapper 32 underneath the bottom of ice cream sandwich 12. In this regard, shoe 18 includes a rear tucker 38 in the form of two adjacent, spaced quadrilateral plates 40 with a space 42 defined therebetween. Plates 40 are secured to the lower end of a pusher 44 which pushes the ice cream sandwich from supporting surface 26 onto take-off conveyor 16 during continued movement in the leftward direction of FIGS. 1 and 4–6 toward and into abutment with ice cream sandwich 12, as shown in FIGS. 5 and 6. Pusher 44 includes a vertical plate 46 with quadrilateral plates 40 being fixedly connected to the lower end of vertical plate 46. An actuator plate 48 is secured to the rear of vertical plate 46 and is controlled by an actuator 50 which moves shoe 18 in the leftward and rightward directions of FIG. 1. Actuator 50 may include any suitable means such as a motor controlled linkage assembly or the like, or may be of a similar configuration to the assembly of U.S. Pat. No. 4,098,057 which moves the supporting plate member thereof. It will be appreciated that any suitable means can be used, which would be readily apparent to those skilled in the art.

Referring now to FIGS. 1 and 2, conveyor 16 includes a conveying surface 52 which is substantially co-planar with supporting surface 26 when elevator 14 is moved to the wrapping position of FIG. 1, wherein an ice cream sandwich 12 can be pushed from supporting surface 26 to conveying surface 52. As shown, conveying surface 52 is cut away to form two recessed sections 54 which are open at the end of conveyor 16 which faces platform 20. Recessed sections 54 are quadrilaterally shaped, having a similar configuration to plates 40. As a result, conveying surface 52 at the aforementioned end of conveyor 16 includes end triangular support surfaces 56 and a central support surface 58 which provides initial support for an ice cream sandwich 12 transferred to take-off conveyor 16.

Referring now to FIGS. 4–6, operation of apparatus 10 will now be described. Referring initially to FIG. 4, elevator 14 raises ice cream sandwich 12 to the wrapping position of FIG. 1, wherein wrapper 32 extends across the top of ice cream sandwich 12 and is draped along the sides thereof. Vertical guides 34 are not show in FIGS. 4–6 for the sake of clarity in the explanation. In such position, shoe 18 is moved in the leftward direction of FIG. 4, that is, in the direction of arrow 60 by actuator 50. It will be appreciated, from the description which follows, that arrow 60 is inclined upwardly. Further, in FIGS. 4–6, an upper limit member 62 is provided for holding down ice cream sandwiches 12 travelling on take-off conveyor 16.

As shown in FIG. 5, as shoe 18 travels along arrow 60, quadrilateral plates 40 tuck rear bottom tuck panel 36 underneath ice cream sandwich 12. Specifically, when shoe 18 moves in the direction of arrow 60, platform 20 begins to descend. Plates 40 initially engage the bottom edge of ice cream sandwich 12. As platform 20 continues to descend, plates 40 wrap rear bottom tuck panel 36 underneath ice cream sandwich 12 and provide the support for ice cream sandwich 12, as shown in FIG. 5. After the position shown in FIG. 5 is obtained, elevator 14 is completely lowered and ice cream sandwich 12 is completely supported by quadrilateral plates 40.

As shown in FIG. 6, upon continued movement of shoe in the direction of arrow 60, vertical plate 46 abuts against one side of ice cream sandwich 12 and biases the latter onto conveyor 16. It will be appreciated that, since quadrilateral plates 40 are fixedly connected to vertical plate 46, these plates 40 also continue to move in the direction of arrow 60. There is thus no need for a separate mechanism for pushing the ice cream sandwiches onto conveyor 16. Because of recessed sections 54 in take-off conveyor 16, quadrilateral plates 40 are not hindered in their movement, as would occur with the rear tucker of U.S. Pat. No. 3,834,119 or the supporting plate member of U.S. Pat. No. 4,098,057, which would hit the conveyor upon further movement. It will be noted that, as ice cream sandwich 12 is pushed by plate 46 onto conveyor 16, front bottom tuck panel 64 of wrapper 32 is tucked underneath ice cream sandwich 12 by conveying surface 52 and is also positioned around quadrilateral plates 40.

After ice cream sandwich 12 is pushed onto conveyor 16, shoe 18 is moved in the opposite direction along arrow 66, as shown in FIG. 6, to the position shown in dashed lines. Because of the inclination of such movement, removal of plates 40 from between rear bottom tuck panel 36 and front bottom tuck panel 64 does not cause any disengagement of rear bottom tuck panel 36 from underneath ice cream sandwich 12. Thus, with the present invention, wrapping of rear bottom tuck panel 36 and pushing of ice cream sandwich 12 onto conveyor 16 can be performed in a single movement by a single integral shoe 18. In addition, because of recessed sections 54, shoe 18 can move in the inclined directions of arrows 60 and 66, whereby rear bottom tuck panel 36 will not be removed with shoe 18 when the latter travels in the direction of arrow 66.

It will be appreciated that various changes and modifications can be made by one of ordinary skill in the art. For example, although two recessed sections 54 and two plates 40 have been described, a single recessed section 54 and a single plate 40 can be used. In such case, ice cream sandwich 12 would be supported only by triangular support surfaces 56 on conveyor 16.

Having described a specific preferred embodiment of the invention with reference to the accompanying drawings, it is to be appreciated that the present invention is not limited to that precise embodiment, and that various changes and modifications may be effected therein by one of ordinary skill in the art without departing from the scope or spirit of the invention as defined by the appended claims.

What is claimed is:

1. Apparatus for wrapping an ice cream sandwich with a wrapper comprising:

elevator means for raising said ice cream sandwich upwardly from a supply position at which said ice cream sandwich is supplied to said elevator means to a wrapping position at which said wrapper extends over the top of and is draped along the sides of said ice cream sandwich, said elevator means including a platform having a supporting surface for supporting said ice cream sandwich;

a conveyor positioned adjacent said platform when the elevator means is moved to said wrapping position, said conveyor including a conveying surface substantially coplanar with said supporting surface when said elevator means is moved to said wrapping position, wherein said ice cream sandwich can be pushed from said supporting surface to said conveying surface, said conveying surface including at least one recessed section open at an end thereof adjacent said platform; and shoe means movable in a direction toward and into abutment with said ice cream sandwich when the latter is supported on said supporting surface, said shoe means including rear tucker means for wrapping a rear bottom tuck panel of said wrapper underneath said cream sandwich as said shoe means travels in said direction toward said ice cream sandwich, and pusher means fixedly connected with said rear tucker means for pushing said ice cream sandwich from said supporting surface onto said conveying surface during continued movement in said direction toward and into abutment with said ice cream sandwich, said rear tucker means extending into said at least one recessed section during said continued movement.

2. Apparatus according to claim 1; wherein said conveying surface includes two spaced recessed sections, each open at an end thereof adjacent said platform.

3. Apparatus according to claim 2; wherein each recessed section has a quadrilateral configuration.

4. Apparatus according to claim 1; further including actuator means for moving said shoe means in said direction toward and into abutment with said ice cream sandwich.

5. Apparatus according to claim 1; wherein said rear tucker means includes at least one plate for wrapping a rear bottom tuck panel of said wrapper underneath said ice ice cream sandwich and extending into said at least one recessed section during such said continued movement.

6. Apparatus according to claim 5; wherein said rear tucker means includes two spaced plates movable to a position underneath said ice cream sandwich as said shoe means is moved in said direction to wrap said rear bottom tuck panel of said wrapper underneath said ice cream sandwich; and said conveying surface includes two spaced recessed sections, each open at an end thereof adjacent said platform, for receiving said spaced plates of said rear tucker means during continued movement of said rear tucker means.

7. Apparatus according to claim 6; wherein each recessed section has a quadrilateral shape, and each plate has a quadrilateral shape of similar size and dimensions to that of a respective recessed section.

8. Apparatus according to claim 6; wherein said pusher means includes a vertical plate, and said spaced plates of said rear tucker means are fixedly connected to a lower end of said vertical plate.

9. Apparatus according to claim 8; further including actuator means for moving said shoe means in said direction toward and into abutment with said ice cream sandwich.

* * * * *